United States Patent [19]

Brown et al.

[11] 4,195,991

[45] Apr. 1, 1980

[54] ELECTROGRAPHIC RECORDING METHOD OF APPLYING AN ELECTRIC FIELD OPPOSITE THE CHARGE RETAINING LAYER

[75] Inventors: Lee R. Brown; L. Herrera José, both of Houston, Tex.; John D. Plumadore, Westfield, Mass.

[73] Assignee: James River Graphics Inc., South Hadley, Mass.

[21] Appl. No.: 844,304

[22] Filed: Oct. 21, 1977

[51] Int. Cl.[2] ..... G03G 15/02; G03G 13/02

[52] U.S. Cl. ..... 430/55; 361/225

[58] Field of Search ..... 96/1 SD, 1.5, 1 R, 1 C; 427/14; 361/225

[56] References Cited

U.S. PATENT DOCUMENTS

| | | | |
|---|---|---|---|
| 2,952,241 | 9/1960 | Clark et al. | 96/1 SD |
| 3,332,396 | 7/1967 | Gundlach | 96/1 SD |
| 3,626,260 | 12/1971 | Kimura | 96/1 C |
| 3,697,172 | 10/1972 | Ohta | 361/225 |
| 3,914,460 | 10/1975 | Maksymiak | 96/1 SD |
| 3,958,988 | 5/1976 | Bixby | 96/1 C |

*Primary Examiner*—Roland E. Martin, Jr.
*Assistant Examiner*—John L. Goodrow
*Attorney, Agent, or Firm*—Joseph H. Yamaoka; John W. Kane, Jr.; William J. Foley

[57] ABSTRACT

An improved electrographic recording apparatus and method. An electrographic recording medium has a charge retaining front surface on which charge is distributed in a pattern representing a desired image to be recorded, and a field permeable conductive layer. While charge is being deposited on the charge retaining surface of the electrographic medium, a field is established and maintained behind the rear surface of the medium, said field penetrating the conductive layer and having a field strength on the charged side of the medium that opposes a field that causes charge to be deposited on the charge retaining surface of the medium. In another aspect of this invention, the recording apparatus has a toner application station that is located apart from the charge depositing means, and a second field, having the same polarity as the first field, is established and maintained behind the rear surface of the electrographic medium at the toner station.

5 Claims, 2 Drawing Figures

ELECTROGRAPHIC RECORDING METHOD OF APPLYING AN ELECTRIC FIELD OPPOSITE THE CHARGE RETAINING LAYER

The Government has rights in this invention pursuant to Contract Number F33615-76C-1312, awarded by the United States Air Force AFSC Aeronautical Systems Division.

BACKGROUND OF THE INVENTION

This invention relates to a process and apparatus for recording images on an electrographic medium and in particular to an improved process and apparatus for recording images on an electrographic medium that has a field permeable conductive layer. A field established behind the rear surface of the medium opposes a field established at the front, or charge retaining, surface of the medium so as to counteract any tendency of the charge on the charge retaining surface of the medium to be distributed in an undesired pattern as a result of defects in the medium.

In one type of electrophotographic recording process, the recording medium is a film having a polyester base, a transparent conductive layer that overlies the polyester base and a photoconductive layer that overlies the transparent conductive layer. To record on the film, a uniform electrostatic charge is first applied, by means of a charging corona element, to the surface of the photo conductive layer of the film. The uniform charge is then selectively dissipated by exposing the surface to a light image of the pattern to be recorded. The resulting pattern of charges is an electrostatic latent image on the surface of the photoconductive layer which can then be rendered visible, for example, in an attraction toning process, by applying thereto electrostatically charged developer particles which are held to the surface of the photoconductive layer by means of the electrostatic force developed between the developer particles and the charge on the surface of the photoconductive layer. A permanent visible image can be obtained, for example, by using developer particles which can be heat fused to the photoconductive layer, and then subjecting the visible image to a heat fusing step.

It is possible for the manufactured film to have defects. Defects can take several forms such as an irregularity in the thickness of the photoconductive layer of the film, or a piece of foreign matter within the photoconductive layer, or a small pinhole in the photoconductive layer of the film. These defects prevent uniform charging of the surface of the photoconductive layer during the charging step of the recording process. Generally, the area of the photoconductive layer at the defect leaks electrically, that is, the area is unable to maintain a desired level of charge. As a result, the area of the defect is at a lower potential than the area surrounding the defect. Because of this potential gradient, a non-uniform field is established in the vicinity of the defect that tends to divert charge, that would otherwise be deposited on the surface of the photoconductive layer to the defect. In some cases, the dissipation of the charge at the defect results in a sufficiently large current level which can vaporize either the delicate conductive layer or the photoconductive layer at that point. In a similar manner, these defects can cause toner particles to be distributed in an undesired pattern in the area of and surrounding the defect. Since the undesired distribution of charge or toner particles occurs in an area surrounding the defect, undesired images are recorded on the film over an area that greatly exceeds the area of the defect. If the undesired image is formed in an area of the film on which a desired image is to be recorded, the recording may be rendered useless.

Although the ideal solution to the defect problem is to provide film that does not have any defects, it would be very desirable for the recording system to be able to minimize this undesired distribution of charge caused by defects in the film. For example, if the undesired distribution of charge or toner particles in the vicinity of a defect could be reduced, the likelihood that an undesired recorded image resulting therefrom would interfere with the recording of a desired image would also be reduced. Furthermore, reducing the initial concentration of charge at the defect may prevent the ultimate vaporization of the film in that area and the film may satisfactorily record an image thereon. In either case, there will be some savings of film material as well as a reduction of the time and effort involved in rerecording images.

It has been observed that if a field is established from the insulative base side of the film that opposes the field established by the charging corona or the field tending to deposit toner particles on the film, the resulting developed image is improved in the vicinity of the defect. It has also been observed that the resulting developed image is considerably poorer in the vicinity of the defect if a field of the opposite polarity is established from the base side of the film. It is believed that the improved recording results because the field established on the base side of the film is able to penetrate the conductive layer of the film. It is also believed that the penetrating field has a greater effect in the vicinity of a defect than in non-defective areas and that the penetrating field, in effect, modulates the field applied from the charged side of the film so as to result in a more uniform field on the charged side of the film, than would exist in the absence of the penetrating field. Since the field on the charged side of the film is more uniform, the tendency to deposit charge or toner particles in an undesired pattern in the vicinity of a defect is reduced.

It is, therefore, the primary object of this invention to provide an improved electrographic recording apparatus and process that will reduce the undesired distribution of charge on a charge retaining surface of a recording medium in the vicinity of a defect in the medium.

It is another object of this invention to provide an improved apparatus and process for recording on an electrographic medium that will reduce the undesired distribution of charge on a charge retaining surface of the medium in the vicinity of a weakened area or hole in a conductive layer of the medium.

And yet another object of this invention is to provide an improved apparatus and process for recording on an electrographic medium that will reduce the undesired distribution of toner particles on the surface of the medium in the vicinity of a defect in the medium.

SUMMARY OF THE INVENTION

In accordance with this invention there is provided an apparatus and a method for recording on an electrographic medium. The electrographic recording medium has a charge retaining front surface on which charge is distributed in a pattern representing a desired image to be recorded, and a conductive layer. While charge is being deposited on the charge retaining surface of the electrographic medium, a field is established and maintained behind the rear surface of the medium, said field penetrating the conductive layer and having a field strength at the conductive layer that opposes the field that causes the charge to be deposited on the charge retaining surface of the medium. In a preferred embodiment of the invention, the field is established by providing an electrode adjacent the rear surface of the electrographic medium and applying a potential thereto having the same polarity as the potential causing charge to be deposited on the charge retaining surface of the medium. The field established by the electrode should extend over the entire working area of the recording medium that is being charged. In another aspect of this invention, when the toner application station is located apart from the charging station, a second electrode is located behind the rear surface of the electrographic medium at the toner station. This second electrode also has applied thereto a potential having the same polarity as that applied to the first electrode.

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

DETAILED DESCRIPTION

Figure 2:
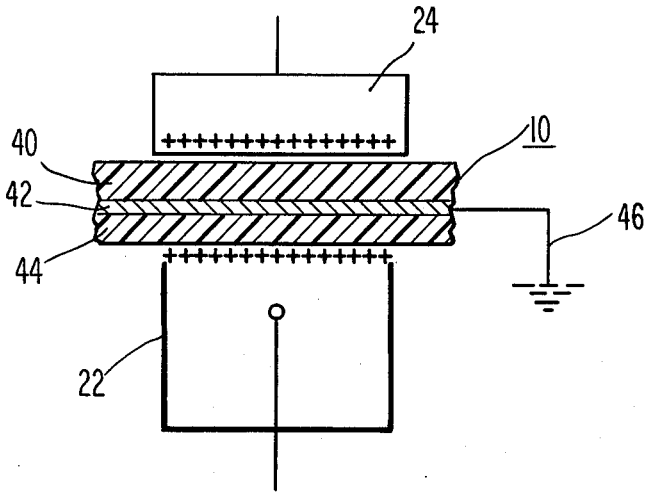
FIG. 2 is an enlarged schematic representation of the charging station illustrated in FIG. 1.

The improved recording system of this invention is particularly useful when recording on electrophotographic film having a multilayered structure as illustrated in FIG. 2. The first layer 40 of electrophotographic film 10 is a polyester base 40, about 125 micrometers thick, that forms an insulative substrate for the film 10. Underlying the polyester base 40 is a second, transparent conductive layer 42 about 0.01 micrometers thick. The film structure is completed by a photoconductive film matrix 44, about 9 micrometers thick, that underlies the transparent conductive layer 42.

Figure 1:
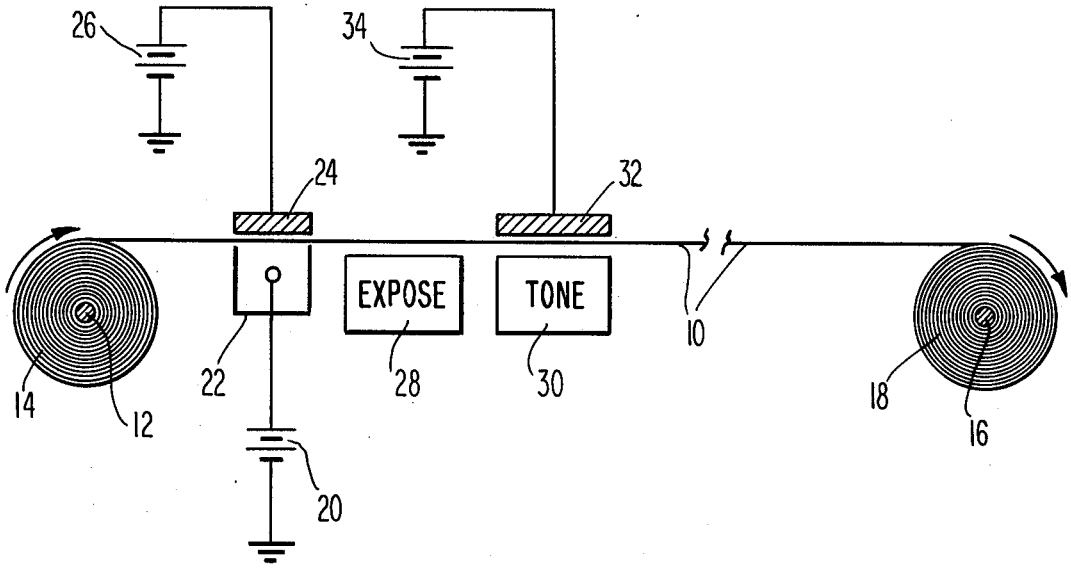
FIG. 1 is a block diagram of a system for recording on an electrographic medium that shows those elements necessary to describe this invention.

For the sake of convenience, an element depicted in more than one figure will retain the same element number in each figure. Referring now to FIG. 1, there is shown a general and partial block diagram of an electrophotographic film recording system. Since such recording systems are well known in the art, only those elements of a recording system necessary to describe this invention have been illustrated. In FIG. 1, electrophotographic film 10 is being transported by conventional means, not shown, from a supply roll 14 mounted on shaft 12 to a take up roll 18 mounted on shaft 16. In accordance with conventional techniques for recording on electrophotographic film 10, a corona charging unit 22 deposits a uniform distribution of charge on the surface of photoconductive layer 44 of electrophotographic film 10. A conventional high voltage power supply 20 energizes the corona charging unit 22. The uniformly charged film 10 is then transported past an exposure station 28. At the exposure station 28, in accordance with well known techniques, the charged surface of photoconductive layer 44 is subjected to a light pattern that corresponds to the desired image to be recorded on the film 10. Those areas of the charged photoconductive layer 44 that are exposed to the light become conductive and the charge originally deposited on those exposed areas of the photoconductive layer 44 will be dissipated. Those areas of the charged photoconductive layer 44 that are not exposed to light will retain a charge thereon. Thus, it can be seen that the combination of corona charging unit 22, high voltage power supply 20 and exposure unit 28 is a means for providing a distribution of charge on the surface of photoconductive layer 44, the distribution of the charge representing a desired image to be recorded on the electrophotographic film 10.

At this stage of the recording process, the distribution of charge representing the desired image to be recorded is referred to as an electrostatic latent image since it is not visible to the naked eye. In order to provide a visible image, the exposed electrophotographic film 10 is transported past a conventional development or toning unit 30 that subjects the exposed film to charged toner particles which are, in an attraction toning process, attracted to the charged areas of the film 10.

Located adjacent the polyester base 40 at the rear of electrophotographic film 10 is a first electrode, or voltage retaining member 24, having a voltage retaining surface that subtends the area of the film that is being uniformly charged by corona unit 22. The electrode 24 is connected to a conventional high voltage power supply 26. The polarity of the potential applied to electrode 24 is the same as the polarity of the potential applied to corona charging unit 22. Also located adjacent the polyester base 40 of electrophotographic film 10 is a second electrode, or voltage retaining member 32, having a voltage retaining surface that subtends the area of the film being developed by the toning unit 30. The second electrode 32 is also connected to a conventional high voltage power supply 34. The polarity of the potential applied to the second electrode 32 is also the same as the polarity of the potential applied to the corona charging unit 22.

Although two separate electrodes 24, 32 are shown in the embodiment of FIG. 1, it may be desirable to have a single electrode that extends from the corona charging unit 22 to the toner application unit 30. It may also be desirable to have either electrode 24 or electrode 32 extend over the exposure station 28. Although electrodes 24, 32 are shown as being flat plate members in FIGS. 1 and 2, an embodiment has been constructed in which the electrodes 24, 32 are roller members. It will also be apparent to those skilled in the art that although high voltage power supplies 20, 26 and 34 have been shown as individual units, the three potentials could be provided by a single high voltage power supply having different voltage taps. Also, it may be desirable to operate electrodes 24 and 32 at the same potential.

As shown in FIG. 1, the corona charging unit 22 is connected to the positive terminal of high voltage power supply 20 and the electrodes 24, 32 are respectively connected to the positive terminals of high voltage power supplies 26 and 34. Thus, as shown in FIG. 2, charging corona unit 22 will cause a uniform distribution of positive charge to be deposited on the surface of photoconductive layer 44. Since electrode 24 is connected to the positive terminal of high voltage power supply 26, a positive charge is maintained on the voltage retaining member 24. The electric field established by electrode 24 opposes the electric field that directs positive charge from charging corona unit 22 onto the surface of photoconductive layer 44. If there is a defect such as a hole in conductive layer 42, it is believed that the electric field established by the voltage applied to electrode 24 is strong enough to penetrate the conductive layer 42 at the defect and establish a more uniform potential gradient in the vicinity of the defect than would exist in the absence of electrode 24. Furthermore, if the conductive layer 42 is an ionic conductive layer which can be highly resistive or if the conductive layer 42 is very thin or even discontinuous in nature, it is believed that an electric field can be established by the potential applied to electrode 24 that penetrates the conductive layer 42 and thus achieves the benefits of this invention. The benefit of this invention is achieved even if the film does not have a hole in the conductive layer, but only has a weakly formed conductive layer, despite the fact that the conductive layer may be connected to ground as shown by the connection 46 in FIG. 2. In a similar manner, a second electrode 32 is located behind the polyester base 40 of electrophotographic film 10 in the vicinity of the toner application unit 30 and could, if desired, subtend that portion of film 10 that is exposed by exposure unit 28. Electrode 32 also establishes an electric field within electrophotographic film 10 which is believed to penetrate the conductive layer 42 and reduces the tendency of charged toner particles to be deposited in an undesired pattern on the surface of photoconductive layer 44 because of a defect in the film 10. In one constructed embodiment of this invention, the voltage applied to the corona charging unit 22 was about 7000 volts and the voltage applied to electrodes 24 and 32 was between about 1500 to 1700 volts.

Thus, it can be seen that in this improved method and apparatus for recording on an electrographic medium, the electric field applied from the rear of the electrographic medium is believed to penetrate the area of a defect in the film. If the conductive layer is very thin or resistive, or very discontinuous, it is believed that the electric field penetrates the conductive layer even though the conductive layer is grounded. The establishment of the electric field at the recording surface of the film due to the potential on the electrodes at the rear of the film reduces the tendency of the charge or charged toner particles to be deposited in an undesired pattern on the recording surface of the film as a result of any defects in the recording medium.

While the present invention has been described with reference to a specific embodiment thereof, it will be obvious to those skilled in the art that various changes and modifications may be made without departing from the invention in its broader aspects.

What is claimed as new and desired to be secured by Letters Patent of the United States is:

1. An improved method of recording on an electrographic medium, said medium comprising a charge retaining layer and a conductive layer, said method of recording comprising the steps of providing a desired distribution of charge of a given polarity on the surface of the charge retaining layer representing an image to be recorded and developing said image, wherein the improvement comprises the step of applying a uniform electric field, having said given polarity, to the medium from the side opposite the charge retaining layer, said electric field penetrating through the conductive layer and having sufficient field strength at the charge retaining layer to reduce the tendency of charge to be deposited in an undesired pattern on the surface of the charge retaining layer as a result of defects in the medium.

2. An improved method of recording as recited in claim 1 wherein charged toner particles are applied to the charged surface of the charge retaining layer during the developing step said improvement additionally comprising the step of applying an electric field, having said given polarity, to the medium from the side opposite the charge retaining layer, said additionally applied field penetrating the conductive layer and having sufficient field strength at the charge retaining layer to reduce the tendency of the charged toner particles to be deposited in an undesired pattern on the surface of the charge retaining layer as a result of defects in the medium.

3. An improved method of recording on an electrophotographic medium, said medium comprising a charge retaining layer and a conductive layer, said method of recording comprising the steps of providing a desired distribution of charge of a given polarity on the surface of the charge retaining layer representing an image to be recorded and applying charged toner particles to the charged surface of the charge retaining layer in order to develop the image, wherein the improvement comprises the step of applying a uniform electric field, having said given polarity, to the medium from the side opposite the charge retaining layer, said field penetrating the conductive layer and having sufficient field strength at the surface of the charge retaining layer to reduce the tendency of the charged toner particles to be deposited in an undesired pattern on the surface of the charge retaining layer as a result of defects in the medium.

4. An improved method of recording on an electrophotographic medium, said medium comprising an insulative substrate, a field permeable conductive layer overlying the substrate and a photoconductive layer overlying the conductive layer, said method of recording comprising the steps of providing a desired distribution of charge of a given polarity on the surface of the photoconductive layer representing an image to be recorded and developing said image, wherein the improvement comprises the step of applying a uniform electric field, having said given polarity, from the substrate side of the medium, said field penetrating the conductive layer and having a polarity and sufficient field intensity at the photoconductive layer to reduce the tendency of the charge to be deposited on the surface of the photoconductive layer in an undesired pattern as a result of defects in the medium.

5. An improved method of recording on an electrophotographic medium, said medium comprising an insulative substrate, a field permeable conductive layer overlying the substrate and a photoconductive layer overlying the conductive layer, said method of recording comprising the steps of providing a desired distribution of charge of a given polarity on the surface of the photoconductive layer representing an image to be recorded and applying charged toner particles to the surface of the charged surface of the photoconductive layer in order to develop the image, wherein the improvement comprises the step of applying a uniform electric field from the substrate side of the medium, having said given polarity and sufficient field intensity to penetrate the conductive layer, said field reducing the tendency of the charged toner particles to be deposited in an undesired pattern on the surface of the photoconductive layer as a result of defects in the medium.

* * * * *